US006447841B1

(12) United States Patent
Mets et al.

(10) Patent No.: US 6,447,841 B1
(45) Date of Patent: Sep. 10, 2002

(54) PLASTIC PIGMENTS FOR DURABLE INK JET PAPER

(75) Inventors: Jeanlynn Mets, Sleepy Hollow, NY (US); Yaoliang Hong, Oakland, NJ (US); Mike Koenig, Goshen; Hiroshi Tomimasu, Monroe, both of NY (US); Jerry Yang, Towaco, NJ (US)

(73) Assignee: International Paper Company, Tuxedo, NY (US)

( * ) Notice: Subject to any disclaimer, the term of this patent is extended or adjusted under 35 U.S.C. 154(b) by 0 days.

(21) Appl. No.: 09/323,901

(22) Filed: Jun. 2, 1999

(51) Int. Cl.[7] ..... B05D 1/38

(52) U.S. Cl. ..... 427/202; 427/203; 427/370; 427/391; 427/420

(58) Field of Search ..... 427/466, 469, 427/152, 195, 197, 201, 256, 288, 420, 428, 557, 559, 370, 385.5, 144, 146, 202, 203, 391

(56) References Cited

U.S. PATENT DOCUMENTS

| | | | | |
|---|---|---|---|---|
| 4,785,313 | A | * | 11/1988 | Higuma et al. |
| 4,900,620 | A | | 2/1990 | Tokita et al. |
| 4,901,084 | A | | 2/1990 | Huguenin et al. |
| 4,902,568 | A | | 2/1990 | Morohoshi |
| 4,944,988 | A | * | 7/1990 | Yasuda et al. |
| 5,185,213 | A | | 2/1993 | Fujita et al. |
| 5,281,467 | A | | 1/1994 | Shimada et al. |
| 5,302,249 | A | | 4/1994 | Malhotra et al. |
| 5,405,678 | A | | 4/1995 | Bilodeau |
| 5,545,504 | A | * | 8/1996 | Keoshkerian et al. |
| 5,936,008 | A | * | 8/1999 | Jones et al. |
| 6,147,139 | A | * | 11/2000 | Shaw-Kleine et al. |
| 6,357,871 | B1 | * | 3/2002 | Ashida et al. |

FOREIGN PATENT DOCUMENTS

| | | | |
|---|---|---|---|
| CA | 2214210 | | 2/1998 |
| CA | 2214210 A | * | 2/1998 |
| EP | 0 826 823 A1 | | 3/1998 |

OTHER PUBLICATIONS

Hackh's Chemical Dictionary, 4$^{th}$ Edition, p. 287, 1969.*

* cited by examiner

*Primary Examiner*—Fred J. Parker
(74) *Attorney, Agent, or Firm*—Stewart L. Gitler; Michael J. Doyle

(57) ABSTRACT

The invention relates to ink jet printing and a process for ink jet printing wherein a coating is formed on an ink receiving layer containing a plastic pigment. The coating is fused into a durable coating which is water-resistant, has some lightfastness, is scratch resistant and can be used in indoor and outdoor environments.

16 Claims, 1 Drawing Sheet

PLASTIC PIGMENTS FOR DURABLE INK JET PAPER

FIELD OF THE INVENTION

This application relates to ink jet printed images and to a method for providing water resistance, some lightfastness, and scratch resistance to wide format and narrow format images such as poster, banners, and photos in both indoor and outdoor environments.

BACKGROUND OF THE INVENTION

Ink jet printed images in wide format size are often laminated providing water resistance. These types of laminations are extremely costly and it is desirable to secure a less costly and easier method which could eliminate the need to use a professional print shop. Providing water resistance would allow one to hang posters or banners for use in outside environments. This invention could also be used for products of various sizes which require water resistance, such as business cards or wallpaper. The invention provides water resistance to ink jet prints of any size. This is extremely beneficial in that it overcomes a shortcoming of ink jet printing when compared to laser printing. The end product produced is durable, holds up in all weather conditions, and is long lasting. The end user can impart the water resistance easily on their own, as well as have it imparted in commercial establishments.

Several prior coatings have been disclosed or suggested for ink jet papers, as described in the following references.

U.S. Pat. No. 4,900,620, Tokita et al, describes a material with bright white pigments which provide quick absorption, good color image, circular dots, and waterproofness. The waterproofness is provided by a water soluble cationic polymer. These white pigments are not plastic pigments and waterproofness is not provided by plastic pigments as is described by the novel invention set forth herein. Further, the patent does not discuss or mention any requirement to heat the coating, that is the printed image which is a step required for finishing the printed product.

U.S. Pat. No. 4,902,568, Morohoshi, relates to a spherical silica and a binder which may include organic pigments such as styrene based plastic pigments in order to improve color forming, optical density, dot shape, ink absorption and to provide coated layer strength. The incidental disclosure of the use of a plastic pigment is not the focus of the coating and it is not used for water resistance. Further, the patent does not mention the essential requirement of fusing or heating the printed image which is an essential step of the process.

U.S. Pat. No. 4,910,084, Yamasaki et al, describes the use of a poly(dialkanol allylamine) or a poly(dialkanol modified alkylene glycol) to provide water resistance and light resistance. There is no mention in the disclosure of the use of plastic pigments, latexes or the requirement to fuse them.

U.S. Pat. No. 4,944,988, Yasuda et al, relates to one coating layer which includes a resinous binder and has a pigment dispersed in the resinous binder to provide a substrate with high absorption, good print quality and surface strength. This patent does not describe a water resistant coating nor does it relate to the use of plastic pigments.

U.S. Pat. No. 5,185,213, Fujita et al, relates to high water resistance for severe environmental outdoor uses by forming a pigment coating layer of calcium carbonate or kaolin clay and a specific resin for water resistance. The binder consists of an epoxy resin and a thermoplastic resin. The thermoplastic resin is a conjugated diene copolymer latex. This patent addresses latexes and focuses on the crosslinking effect with the pigment and resin to provide water resistance. There is no mention of the necessity to fuse or heat the latex.

U.S. Pat. No. 5,281,467, Shimada et al, addresses calcium carbonate-compounded silica and other pigments as well as cationic polyelectrolytes which are coated by a cast coating method to produce a material with resistance. The coating method is vastly different from that set forth in the application, and the water resistance is provided by the cationic polymers and not by plastic pigments. The plastic pigments set forth in the invention are not fused or heated.

U.S. Pat. No. 5,302,249, Malhotra et al, relates to coatings which include a desizing component and a hydrophilic polymer to provide a rapid drying paper without print-through and intercolor bleed. Plastic pigments are not suggested or used in this patent.

U.S. Pat. No. 5,405,678, Bilodeau, relates to a hydrophobic polymeric latex which is not fully coalesced and provides a porous coating. The patent does not mention water resistance nor does it discuss the concept of heat fusing or melting. The latex particles remain as discrete spheres on the paper substrate.

Canadian Patent No. 2,214,210 relates to special paper and a process for producing the special paper. The patent addresses applying a film-forming coating that contains organic pigments and binders to at least one side of a paper. Nowhere does the patent contemplate the use of discrete particles of a plastic pigment material and its application to a "coated" paper which acts as the ink receiving layer. The patent fails to recognize the unexpected benefit of coating the paper base, nor does it recognize the unique and beneficial use of discrete particles to obtain a durable finish for ink jet printed images.

The discrete particles facilitate the integration of ink jet ink in the voids and interstices present therewith to obtain the a desired result.

It is an objective of the process and coating to provide a water-resistant plastic pigment coating for ink jet substrates of any size.

It is a further objective of the invention to provide an end product which is durable, i.e., it is water-resistant, has some lightfastness, is scratch resistant, and is longer lasting than unprotected ink jet images.

It is a further objective of the invention to provide a coating which is fused to provide an end product which is durable and is comparable to laminated ink jet images.

SUMMARY OF THE INVENTION

The invention focuses on a method and a coating for providing water resistance to ink jet substrates. The method focuses on the use of a plastic pigment composed of discrete particles being coated onto an ink receiving layer and then being subsequently heated to a temperature at, or above, its melting point to form a fused and water-resistant durable coating layer.

The water resistance is provided by using plastic pigments which can include but are not limited to styrene polymers, acrylic polymers, or acrylic urethane polymers. The plastic pigments remain as discrete particles until the temperature goes at, or above, their melting point, at which time they flow and form a continuous, water impermeable film.

BRIEF DESCRIPTION OF THE DRAWINGS

These and other features of the present invention are best understood through a reference to the drawings in which.

DETAILED DESCRIPTION OF THE PREFERRED EMBODIMENTS

Figure 1:
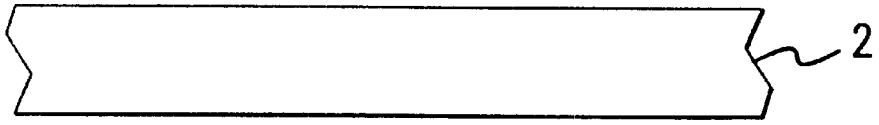
FIG. 1 is a cross sectional view of an ink jet substrate having a plastic pigment coating thereon.
Figure 2:
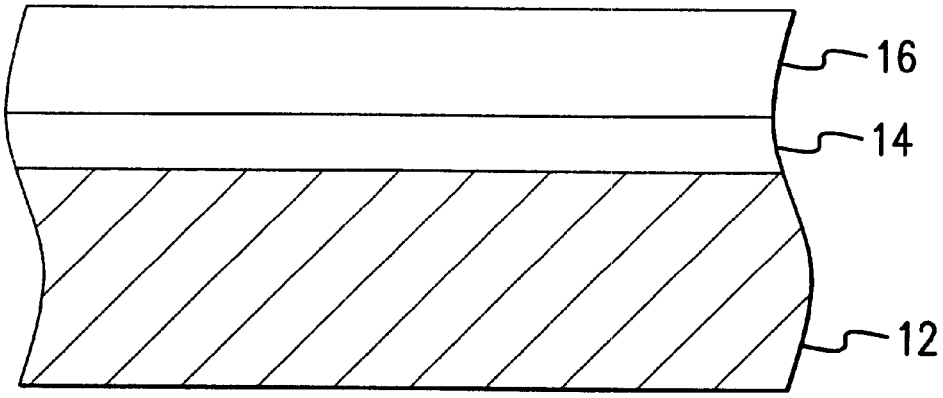
FIG. 2 is a cross sectional view of an alternate embodiment of the invention wherein an ink jet substrate has an ink receiving layer coated between itself and the plastic pigment coating layer.

Referring to FIG. 1, the coating is made up of plastic pigments 2 of the same size, or different sizes, of discrete spherical particles to provide interstices for ink absorption. FIG. 1 depicts a one layer version, wherein the plastic pigments 2 are mixed into the ink jet layer which is composed of a binder and an absorbent pigment FIG. 2, which depicts a two layer version, and shows an ink jet substrate 12 being coated with an ink jet receiving layer 14 and a top layer 16 which contains a binder, additives, and a plastic pigment.

The water resistance is provided by using plastic pigments, which includes but are not limited to styrene polymers, acrylic polymers, or acrylic urethane polymers. The plastic pigments remain as discrete spherical particles until the temperature goes at, or above, their melting point, at which time they flow and form a continuous, water impermeable film. It is also possible, if desired, to provide light fastness by using special plastic pigments which contain ultraviolet absorbers or antioxidants or adding ultraviolet absorbers or antioxidants into the coating at a subsequent time prior to the fusing step of the process. This addition will provide an even more permanent ink jet grade.

The discrete plastic particles range from approximately 0.1 to 1.5 microns, with a preferred range being between approximately 0.3 to 0.6 microns.

During ink jet printing, the ink travels around the plastic pigments and reaches the ink receiving layer. The melting point of the plastic pigments is reached by passing the printed sample through a heating step such as a heated laminator roll, a dryer (such as an infrared, forced air, conduction, convection), microwave oven, heat gun, or passing an iron over the surface. The surface is then fused into a water-resistant durable layer.

Coating of the ink receiving layer can be accomplished by rod coating, slot die coating, curtain coating, air knife coating, or any other suitable coating method.

Heating of the coated substrate can be direct or indirect and can be accomplished by a heated solid surface, a heated gas, a heated liquid, radiation or light.

If silicone rubber laminator rolls are used, the printed image can be fed through without a release liner to yield a matte finish. However, a glossy image can be imparted by using a very smooth liner or roll sleeve which can be coated with silicone, Teflon® (polytetrafluoroethylene), other release coating or other low surface energy material. If an iron is used, depending on if there is a release coating on the iron, the use of a release liner may be required. In addition, depending on the smoothness of the liner, a glossy, semi-luster, or matte finish is imparted.

To eliminate coating cracks and to improve release during heat fusing, wax additives and fluoropolymer emulsions may be added.

Different types of absorbent pigments can be used with the plastic pigments to absorb the ink. In addition, additives may be included to increase light fastness as well. Further, the bottom substrate, that is the ink jet substrate, can be a coated paper, a synthetic paper, a polymer film or a non-woven.

Further, although a desirable use for the plastic pigment coating and process is ink jet printing, improved durability can be provided for prints made on a laser printer as well. The temperature of the fuser roll in the laser printer and the time it takes for the paper to travel across the fuser roll can be modified so that the fuser roll can act as the heating step to convert the plastic pigments into the end product water-resistant film.

The inventive process and coating are a major leap over conventional printing methods which include professional lamination and allow consumers to produce durable ink jet images for indoor and outdoor use by using something as simple as an iron.

EXAMPLE 1

The following is exemplary of the inventive method.

A coating mixture with a solid content of about 44% by weight was prepared by mixing two acrylic urethane latexes with different glass transition temperatures. About 40 parts of the lower Tg latex was mixed with about 60 parts of the higher Tg latex. Both latexes were manufactured by HB Fuller Company. Then the coating mixture was coated by a rod coater so that the coating weight was about 15 gsm (grams per square meter) when dried, followed by drying. Then, after ink jet printing an image thereon, the coating sheet was fused by a laminator or iron to provide a water-resistant and durable ink jet image.

Although several embodiments have been described in detail, it should be understood that various changes, substitutions and alterations can be made therein without departing from the spirit and scope of the invention as defined by the appended claims.

What is claimed is:

1. A method for providing water resistance to an ink receiving layer comprising the steps of:

a) coating a layer of an ink jet receiving material on said ink receiving layer;

b) coating a plastic pigment composed of discrete particles on said ink jet receiving material to form a coated substrate; and c) heating said coated substrate following ink printing at or above a melting point of said plastic pigment.

2. The method of claim 1, wherein said plastic pigment further comprises a binder and an absorbent pigment.

3. The method of claim 1, wherein said discrete particles have different sizes, said discrete particles are the same size, or said discrete particles are a mixture of particles of different sizes and the same size.

4. The method of claim 1, wherein a size of said discrete particles ranges from approximately 0.1 to 1.5 microns.

5. The method of claim 1, wherein a size of said discrete particles ranges from approximately 0.3 to 0.6 microns.

6. The method of claim 1, wherein said plastic pigment is an organic polymer.

7. The method of claim 6, wherein said organic polymer is a styrene polymer, an acrylic polymer, an acrylic urethane, or mixtures thereof.

8. The method of claim 1, wherein said plastic pigment contains an ultraviolet absorber material, or an antioxidant.

9. The method of claim 1, wherein said plastic pigment contains wax additives or fluoropolymer emulsions.

10. The method of claim 1, wherein said ink receiving layer is a coated paper, a synthetic paper, a polymer film, or a non-woven.

11. The method of claim 1, wherein said heating is accomplished direct or indirect heating.

12. The method of claim 11, wherein said heating is accomplished by a heated solid surface, a heated gas, a heated liquid, radiation or light.

13. The method of claim 12, wherein said heating is accomplished by a heated laminator roll, a dryer, or passing an iron over said coated substrate.

14. The method of claim 1, further comprising applying a release liner or sleeve on said coated substrate to facilitate said heating.

15. The method of claim 14, wherein said release liner is made of silicone or polytetrafluoroethylene.

16. The method of claim 1, wherein said coating of said ink receiving layer is accomplished by rod coating, slot die coating, curtain coating or air knife coating.

* * * * *

UNITED STATES PATENT AND TRADEMARK OFFICE

CERTIFICATE OF CORRECTION

PATENT NO. : 6,447,841 B1
DATED : September 10, 2002
INVENTOR(S) : Gruen et al.

It is certified that error appears in the above-identified patent and that said Letters Patent is hereby corrected as shown below:

Title page,
Item [75], Inventor Orlando Auciello, "Bolinbrook" should be -- Bolingbrook --.

Column 5,
Line 39, after the word "responsible", delete ";".

Signed and Sealed this

Eighteenth Day of February, 2003

JAMES E. ROGAN
*Director of the United States Patent and Trademark Office*